US006217111B1

(12) United States Patent
Tseng

(10) Patent No.: US 6,217,111 B1
(45) Date of Patent: Apr. 17, 2001

(54) FOLDABLE CHAIR ASSEMBLY

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/542,224

(22) Filed: Apr. 4, 2000

(51) Int. Cl.[7] ..... A47C 4/00
(52) U.S. Cl. ..... 297/39; 297/35
(58) Field of Search ..... 297/39, 35, 40, 297/16.1, 47

(56) References Cited

U.S. PATENT DOCUMENTS 2,072,074 * 2/1937 Travers et al. .
2,072,075 * 2/1937 Travers et al. .
3,715,142 * 2/1973 Lay et al. .
5,735,570 * 4/1998 Tseng .
6,062,639 * 5/2000 Hill .

* cited by examiner

*Primary Examiner*—Milton Nelson, Jr.
(74) *Attorney, Agent, or Firm*—Ladas & Parry

(57) ABSTRACT

A foldable chair assembly includes a backrest member, a seat member pivoted to the backrest member, two elongated armrest members with rear ends pivoted to the backrest member, two front leg members and two rear leg members. Each armrest member has a first portion proximate to a lateral side of the seat member, and a second portion distal to the lateral side of the seat member. Each front leg member has an upper end pivoted to the first portion of a respective armrest member, a lower end, and an intermediate portion pivoted to the seat member. Each rear leg member has an upper end pivoted to the second portion of a respective armrest member, a lower end, and an intermediate portion pivoted to the backrest member. When the chair assembly is in a folded state, the backrest member, the seat member, the armrest members and the front and rear leg members are substantially upright, and the front leg members are disposed between the rear leg members and are generally parallel to the rear leg members.

7 Claims, 9 Drawing Sheets

FOLDABLE CHAIR ASSEMBLY

BACKGROUND OF THE INVENTION

1. Field of the Invention

The invention relates to a foldable chair assembly, more particularly to a foldable chair assembly which has a significantly reduced thickness and which occupies a relatively small amount of storage space when folded.

2. Description of the Related Art

FIG. 1 illustrates a conventional chair assembly 1 which includes a seat member 2, a backrest member 3, a pair of elongated armrest members 13 (only one is visible) a pair of front leg members 11 (only one is visible), and a pair of rear leg members 12 (only one is visible). The backrest member 3 has a lower end connected pivotally to a rear end portion of the seat member 2 by means of a pair of pivot plates 20 disposed on lateral sides of the chair assembly 1 and by means of pivot pins 201, 202 that extend through the pivot plates 20 such that the seat member 2 is foldable toward the backrest member 3 and is stretchable from the backrest member 3. The armrest members 13 have rear ends extending respectively to lateral sides of the backrest member 3 above the pivot plates 20 and connected pivotally to the backrest member 3 by means of pivot pins 133. The front and rear leg members 11, 12 are disposed respectively on lateral sides of the seat member 2. Each of the front leg members 11 has an upper end connected pivotally to a front end of a respective one of the armrest members 13 by means of a pivot pin 131, a lower end to be supported on a ground surface, and an intermediate portion connected pivotally to the seat member 2 by means of a pivot pin 21. Each of the rear leg members 12 is disposed rearwardly of a respective one of the front leg members 11, and has an upper end connected pivotally to an intermediate portion of a respective one of the armrest members 13 by means of a pivot pin 132, a lower end to be supported on the ground surface, and an intermediate portion connected to an adjacent one of the pivot plates 20 by means of a pivot pin 22. Referring to FIG. 2, to fold the chair assembly 1, the seat member 2 and the armrest members 13 are turned rearwardly to pivot toward the backrest member 3. After the chair assembly 1 is folded, the seat member 2 is folded on and is disposed in front of the backrest member 3, the armrest members 13 are disposed respectively on the lateral sides of the backrest member 3, and the front leg members 11 are disposed in front of and adjacent to the rear leg members 12, respectively. The chair assembly 1, in its folded state, has a thickness which is measured between front and rear sides of the chair assembly 1 in the folded state and which is generally equal to the combined thickness of the backrest member 3 and an adjacent pair of the first and second leg members 11, 12. It is desirable to further reduce the thickness of the chair assembly in its folded state so as to reduce the storage space occupied thereby.

SUMMARY OF THE INVENTION

The object of the present invention is to provide a foldable chair assembly which has a significantly reduced thickness in its folded state such that the chair assembly occupies a relatively small amount of storage space when folded.

Accordingly, the foldable chair assembly of the present invention includes a backrest member, a seat member, a pair of elongated armrest members, a pair of front leg members, a pair of rear leg members, and a pair of pivot members. The backrest member has a lower end, an upper end, and an intermediate portion between the upper and lower ends. The seat member has a rear end portion connected pivotally to the lower end of the backrest member, and a front end portion extending forwardly from the rear end portion. The armrest members are disposed respectively on two opposite lateral sides of the seat member. Each of the armrest members has a rear end which extends to a respective one of the two opposite lateral sides of the backrest member and which is connected pivotally to the intermediate portion of the backrest member. Each of the armrest members further has a first portion which is proximate to the respective one of the lateral sides of the seat member, and a second portion which is distal to the respective one of the seat member in a transverse direction transverse to a longitudinal direction of the armrest member. The front leg members are disposed respectively at the lateral sides of the seat member. Each of the front leg members has an upper end mounted pivotally on the first portion of a respective one of the armrest members, a lower end which is adapted to be disposed on a ground surface, and an intermediate portion extending between the upper and lower ends and connected pivotally to the front end portion of the seat member. The rear leg members are disposed respectively at the lateral sides of the seat member, and are disposed rearwardly of the front leg members, respectively. Each of the rear leg members has an upper end mounted pivotally on the second portion of a respective one of the armrest members, a lower end adapted to be disposed on the ground surface, and an intermediate portion extending between the upper and lower ends of the rear leg member. The pivot members are disposed respectively at the lateral sides of the backrest member. Each of the pivot members has a first end mounted pivotally on the lower end of the backrest member, and a second end mounted pivotally on the intermediate portion of a respective one of the rear leg members. The chair assembly is movable between an unfolded state, in which the backrest member and the front and rear leg members are substantially upright, and the seat member and the armrest members are substantially horizontal, and a folded state, in which the backrest member, the seat member, the armrest members and the front and rear leg members are substantially upright and in which the front leg members are disposed between the rear leg members and are generally parallel to the rear leg members.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 3:
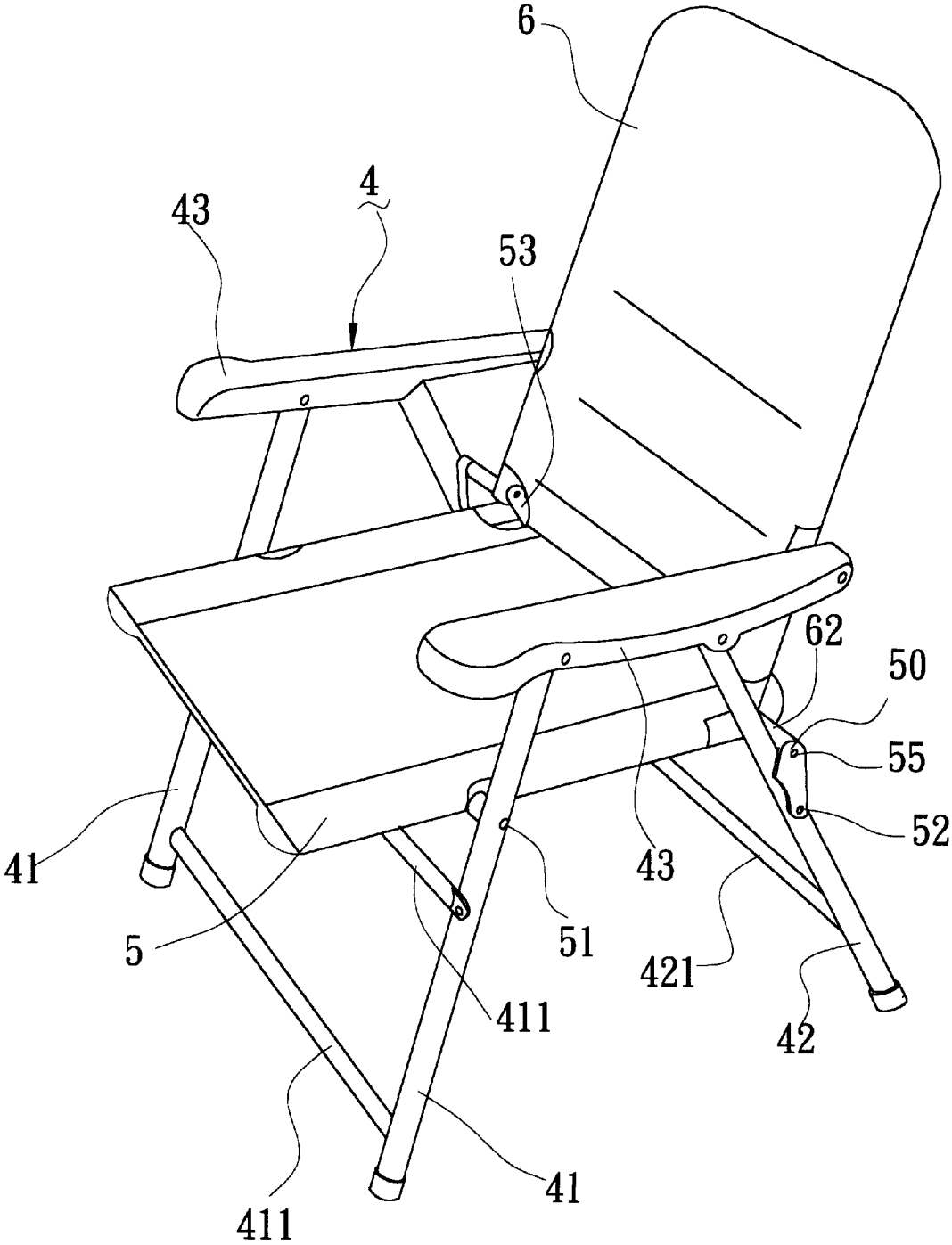
FIG. 3 is a perspective view of a first preferred embodiment of the foldable chair assembly of the present invention in an unfolded state.
Figure 4:
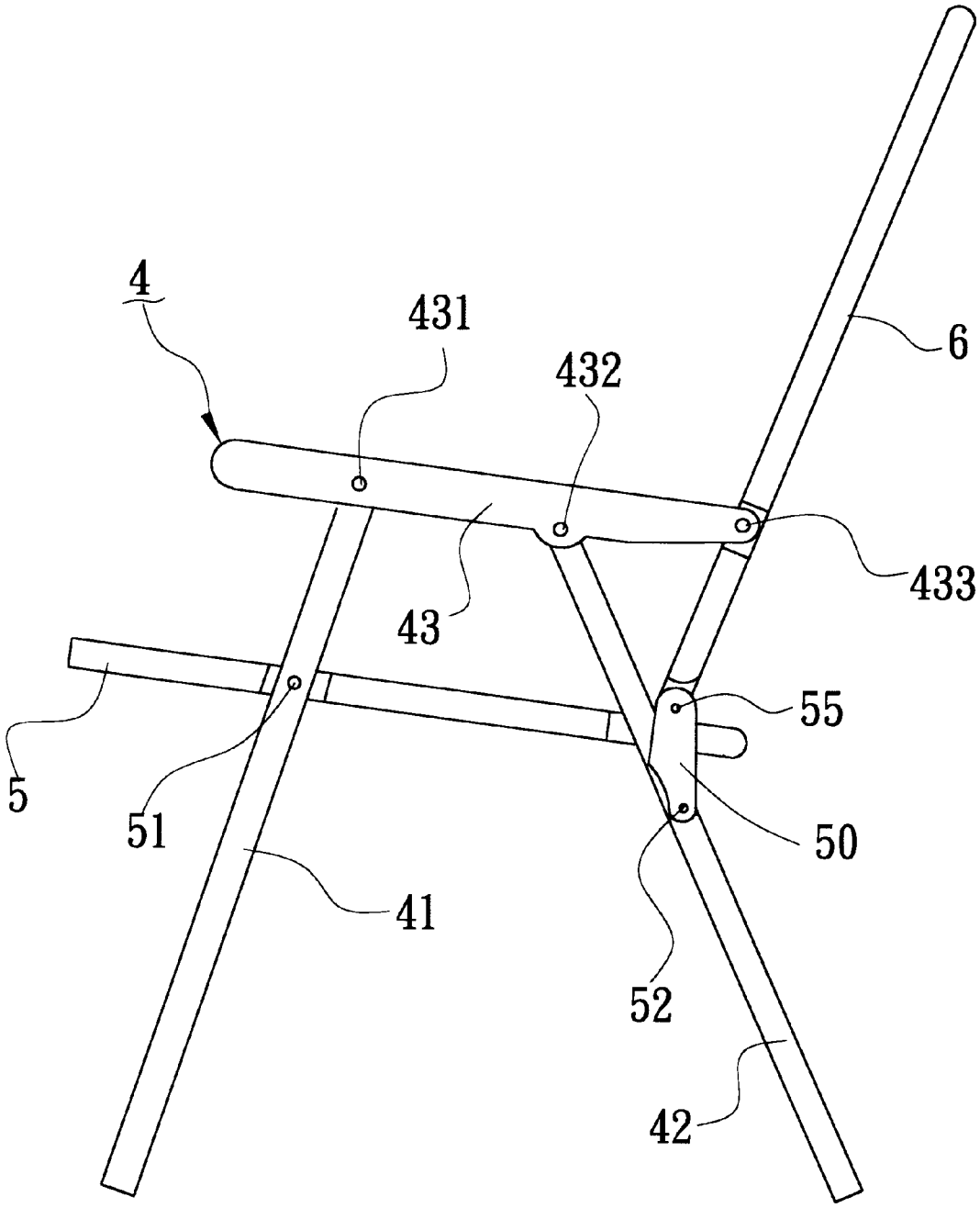
FIG. 4 is a side view of the first preferred embodiment.

Referring to FIGS. 3 and 4, the first preferred embodiment of the foldable chair assembly 4 of the present invention is shown to include a seat member 5, a backrest member 6, a parallel pair of front leg members 41, a parallel pair of rear leg members 42, a pair of elongated armrest members 43, and a pair of pivot members 50.

The backrest member 6 has an upper end, a lower end and an intermediate portion extending between the upper and lower ends. The lower end of the backrest member 6 is formed with a pair of lateral extensions 62 that project laterally from the backrest member 6. The seat member 5 has a rear end portion connected pivotally to the lower end of the backrest member 6 by means of a pair of pivot connectors 53(only one is visible in FIG. 3) such that the seat member 5 is foldable rearwardly toward the backrest member 6 and is stretchable forwardly from the backrest member 6.

The front leg members 41 are disposed respectively on two opposite lateral sides of the seat member 5. Each of the front leg members 41 has a lower end adapted to be disposed on a ground surface, an upper end connected pivotally to a respective one of the armrest members 43, and an intermediate portion which extends between the upper and lower ends and which is connected pivotally to a front end portion of the seat member 5 by means of a pivot pin 51. A pair of front linking rods 411 are disposed below the seat member 5, and extend transversely between the front leg members 41 to interconnect the front leg members 41.

The rear leg members 42 are disposed rearwardly of the front leg members 41 and are disposed respectively on the lateral sides of the seat member 5. A rear linking rod 421 is disposed below the backrest member 6, and extends transversely between the rear leg members 42 to interconnect the rear leg members 42. Each of the rear leg members 42 has a lower end adapted to be disposed on the ground surface, an upper end connected pivotally to a respective one of the armrest members 43, and an intermediate portion which extends between the upper and lower ends and which is mounted pivotally to the lower end of the backrest member 6 by means of a respective one of the pivot members 50. Each of the pivot members 50 has an upper end connected pivotally to a respective one of the lateral extensions 62 at the lower end of the backrest member 6 by means of an upper pivot pin 55, and a lower end pivoted to the intermediate portion of a respective one of the rear leg members 42 by means of a lower pivot pin 52.

Figure 5:
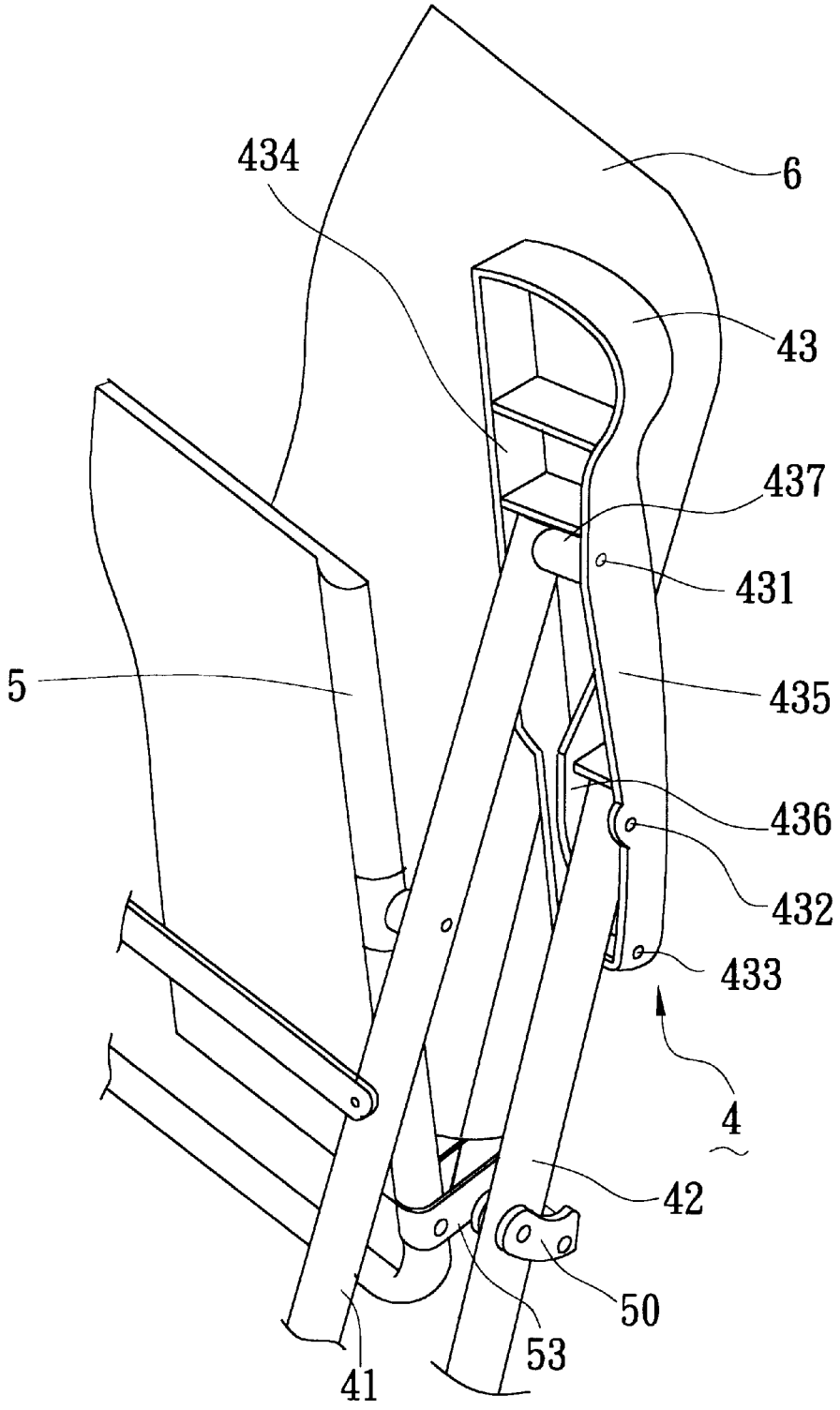
FIG. 5 is a fragmentary perspective view of the first preferred embodiment to illustrate a folding operation thereof.

The armrest members 43 are disposed respectively on the lateral sides of the seat member 5, and have rear ends extending respectively to two opposite lateral sides of the backrest member 6 and connected pivotally to the intermediate portion of the backrest member 6 by means of pivot pins 433. Referring to FIG. 5, each of the armrest members 43 has a longitudinal first side wall 434 proximate to the respective one of the lateral sides of the seat member 5 and a longitudinal second sidewall 435 opposite to and spaced apart from the first side wall 434 and distal to the respective one of the lateral sides of the seat member 5 in a transverse direction transverse to a longitudinal direction of the armrest member 43. Each of the armrest members 43 has a bottom side formed with a downwardly extending partition wall 436 between the first and second side walls 434, 435. The partition wall 436 extends in the longitudinal direction of the armrest member 43 for dividing the armrest member 43 into a first portion proximate to first side wall 434, and a second portion proximate to the second side wall 435. The upper end of each of the front leg members 41 extends to the bottom side of the respective one of the armrest members 43, and is disposed proximate to the first side wall 434. The upper end of each front leg member 41 is connected pivotally to the respective armrest member 43 by means of a pivot pin 431 that extends between the first and second side walls 434, 435 of the respective armrest member 43. A stop member 437, in the form of a sleeve, is sleeved on the pivot pin 431 and is disposed between the upper end of the respective front leg member 41 and the second side wall 435 of the respective armrest member 43 so as to retain the upper end of the respective front leg member 41 in the first portion and to prevent the upper end of the respective front leg member 41 from moving toward the second side wall 435. The upper end of each of the rear leg members 42 extends to the bottom side of the respective one of the armrest members 43, and is disposed between the second side wall 435 and the partition wall 436. The upper end of each rear leg member 42 is connected pivotally to the respective armrest member 43 by means of a pivot pin 432 which extends transversely between the second side wall 435 and the partition wall 436.

As shown in FIG. 4, when the chair assembly 4 is in an unfolded state, the seat member 5 and the armrest members 43 are substantially horizontal, and the backrest member 6 and the front and rear leg members 41, 42 are substantially upright.

Figure 1:
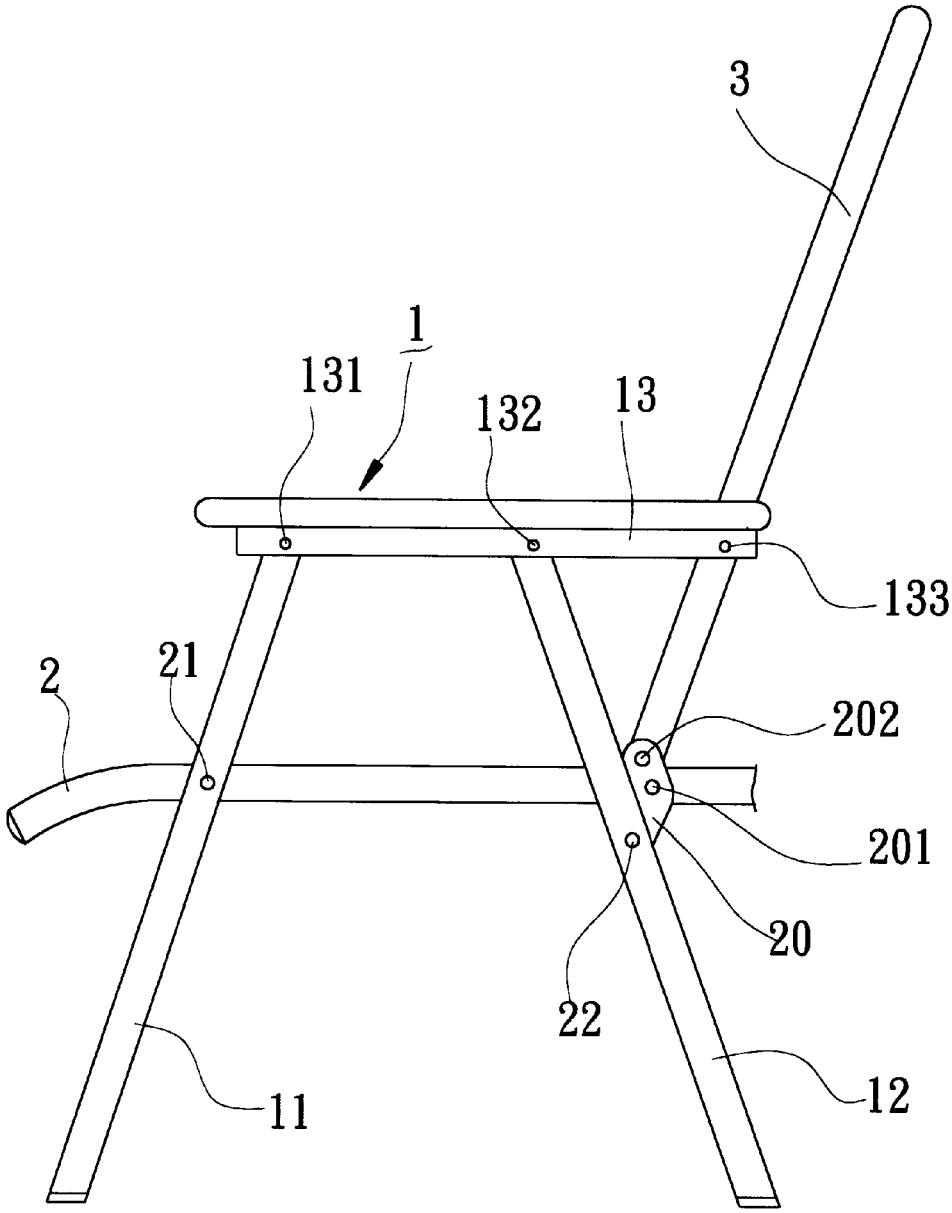
FIG. 1 PRIOR ART
FIG. 1 is a side view of a conventional chair assembly in an unfolded state.
Figure 2:
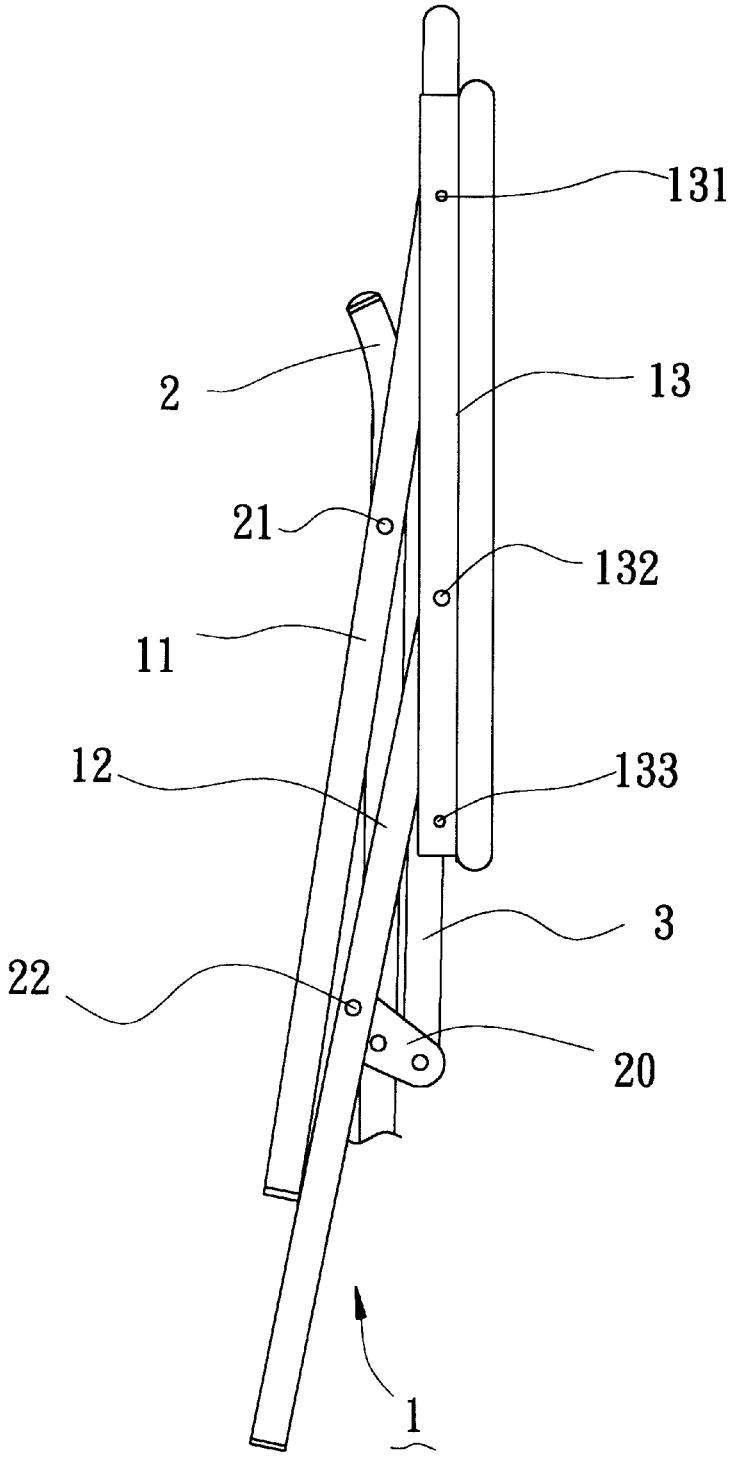
FIG. 2 PRIOR ART
FIG. 2 is a side view of the conventional chair assembly in a folded state.
Figure 6:
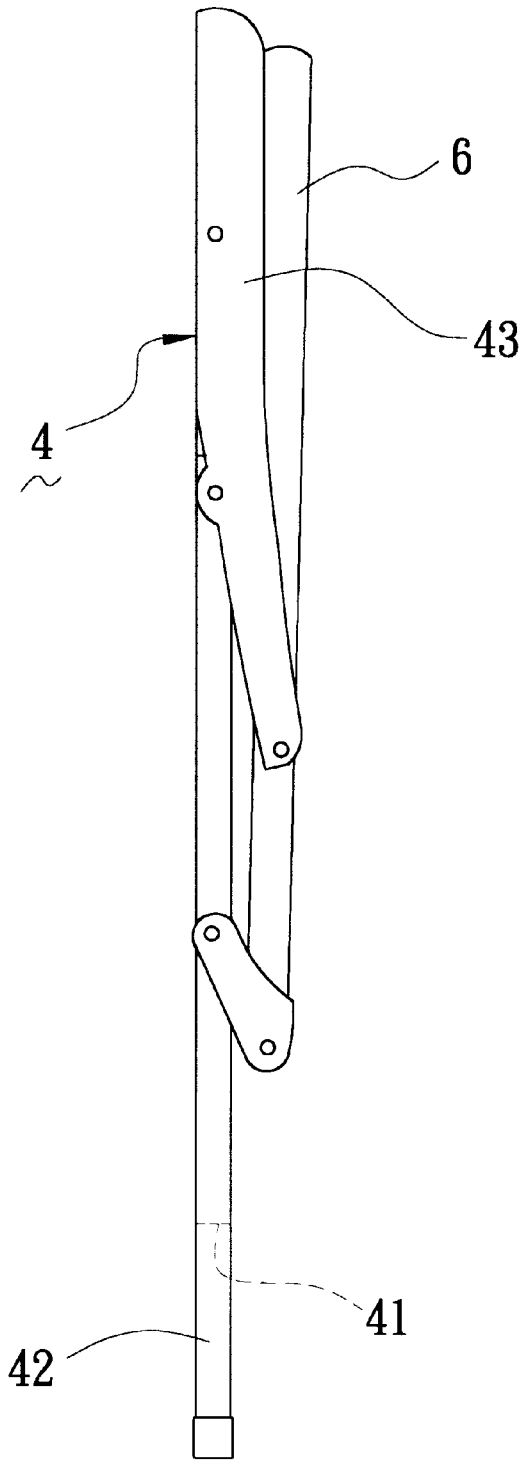
FIG. 6 is a side view of the first preferred embodiment in a folded state.
Figure 7:
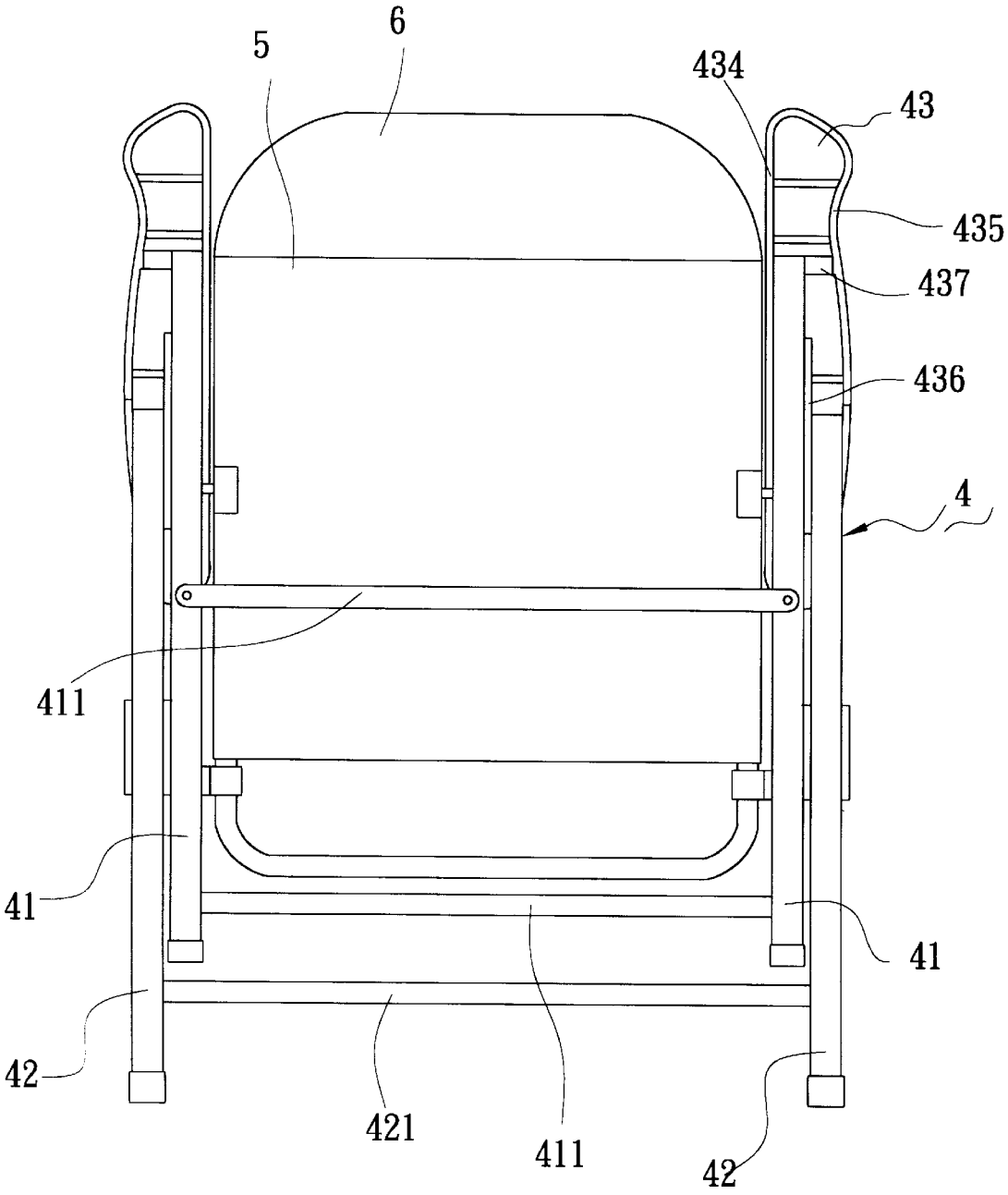
FIG. 7 is a front elevational view of the first preferred embodiment in the folded state.

Referring to FIGS. 5 to 7, when the chair assembly 4 is folded, the seat member 5 pivots rearwardly for folding on the backrest member 6, the armrest members 43 pivot rearwardly so as to be disposed respectively on the lateral sides of the backrest member 6, and the front leg members 41 are moved rearwardly with the seat member 5 and the armrest members 43 toward the corresponding one of the rear leg members 42. When the chair assembly 4 is in a folded state, as shown in FIGS. 6 and 7, the seat member 5, the backrest member 6, the armrest members 43, and the front and rear leg members 41, 42 are substantially upright. In this situation, each of the front leg members 41 is disposed between the first side wall 434 and the partition wall 436 of the respective one of the armrest members 43, and each of the rear leg members 42 is disposed between the second side wall 435 and the partition wall 436 of the respective one of the armrest members 43. The pair of front leg members 41 are thus disposed between and are parallel to the pair of rear leg members 42. As shown in FIG. 6, the thickness of the chair assembly 4 measured between front and rear sides thereof is significantly reduced when compared with the conventional chair assembly 1 shown in FIG. 2. This results in a significant reduction in the storage space occupied by the chair assembly 4 when folded.

It is noted that, the rear linking rod 421, which interconnects the rear leg members 42, is disposed at a position to allow the front leg members 41 and the front linking rods 411 to extend between the rear leg members 42 without contacting the rear linking rod 421 when the chair assembly 4 is folded.

Figure 8:
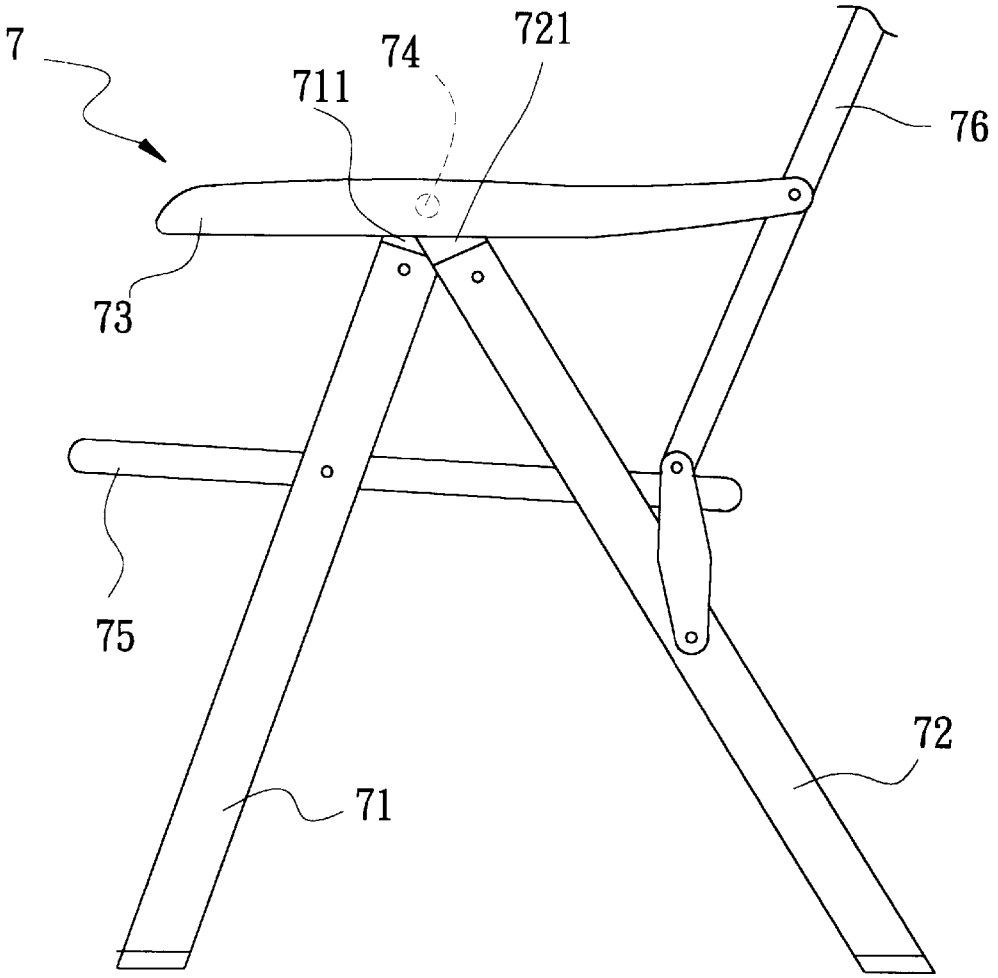
FIG. 8 is a side view of a second preferred embodiment of the foldable chair assembly of the present invention in an unfolded state.
Figure 9:
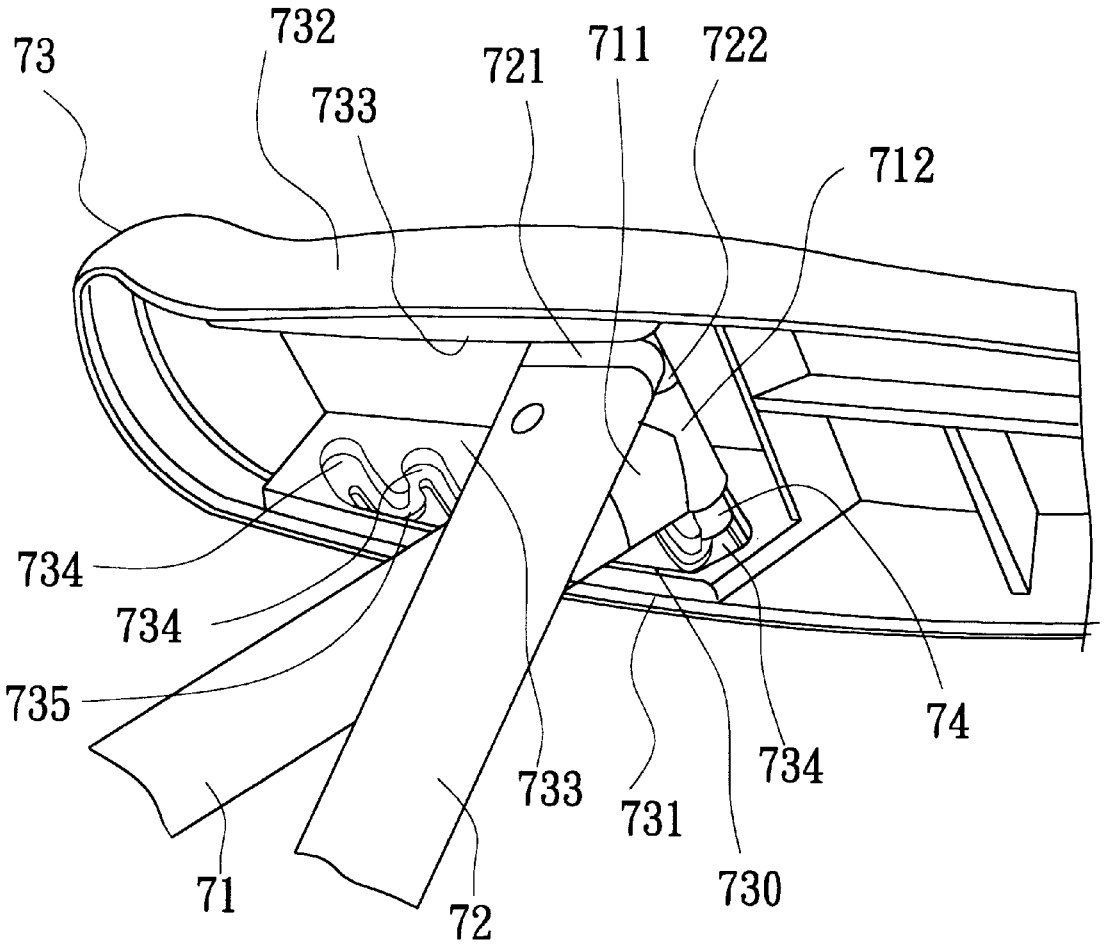
FIG. 9 is a fragmentary perspective view of the second preferred embodiment, illustrating how a front leg member and a rear leg member are connected to an armrest member.

Referring to FIGS. 8 and 9, the second preferred embodiment of the chair assembly 7 of the present invention is shown to also include a seat member 75, a backrest member 76, a pair of armrest members 73 (only one is shown), a pair of front leg members 71 (only one is shown), and a pair of rear leg members 72 (only one is shown). The structure of the chair assembly 7 is similar to that of the first preferred embodiment, except for the connection among the armrest members 73 and the front and rear leg members 71, 72. Each of the armrest members 73 has a first side wall 731 proximate to a respective lateral side of the seat member 75, and a second side wall 732 which is opposite to and spaced apart from the first side wall 731 and which is distal to the respective lateral side of the seat member 75 in a transverse direction transverse to a longitudinal direction of the armrest member 73. Each of the armrest members 73 has a bottom side provided with a cylindrical pivot shaft 74 which extends transversely between the first and second side walls 731, 732. The pivot shaft 74 has a first section proximate to the first side wall 731, and a second section proximate to the second side wall 732. The upper end 711 of each of the front leg members 71 is provided with a first tubular sleeve 712 which is sleeved rotatably on the first section of the pivot shaft 74 of the respective one of the armrest members 73. The upper end 721 of each of the rear leg members 72 is provided with a second tubular sleeve 722 which is sleeved rotatably on the second section of the pivot shaft 74.

Each of the first and second side walls 731, 732 has an inner surface 733 confronting the other one of the first and second side walls 731, 732 and formed with a retaining groove 730 which includes a slide groove portion 735 that extends in the longitudinal direction of the armrest member 73, and a series of engaging groove portions 734 that are communicated with the slide groove portion 735 and that extend upwardly from the slide groove portion 735. The pivot shaft 74 has two opposite ends which extend respectively into the retaining grooves 730 in the inner surfaces 733 of the first and second side walls 731, 732, and which are slidable along the slide groove portions 735 for extension into a selected confronting pair of the engaging groove portions 734, thereby permitting adjustment of the inclination of the backrest member 76. When the chair assembly 7 is in an unfolded state, the pivot shaft 74 of each armrest member 73 engages a selected pair of the engaging groove portions 734 in the armrest member 73 for positioning the backrest member 76 at a desired inclination.

Similarly, when the chair assembly 7 is folded, the front leg members 71 are disposed between the rear leg members 72 and are parallel to the rear leg members 72 so as to result in a significant reduction in the thickness of the chair assembly 7 in the folded state, thereby reducing the storage space occupied by the chair assembly 7 when folded.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A foldable chair assembly comprising:

a backrest member having a lower end, an upper end, an intermediate portion between said upper and lower ends, and opposite lateral sides;

a seat member having a rear end portion connected pivotally to said lower end of said backrest member, a front end portion extending forwardly from said rear end portion, and opposite lateral sides;

a pair of elongated armrest members disposed respectively on said lateral sides of said seat member, each of said armrest members having a rear end which extends to a respective one of said lateral sides of said backrest member and which is connected pivotally to said intermediate portion of said backrest member, each of said armrest members having a first portion which is proximate to the respective one of said lateral sides of said seat member and a second portion which is distal to the respective one of said lateral sides of said seat member in a transverse direction transverse to a longitudinal direction of said armrest member;

a parallel pair of front leg members disposed respectively at said lateral sides of said seat member, each of said front leg members having an upper end mounted pivotally on said first portion of a respective one of said armrest members, a lower end which is adapted to be disposed on a ground surface, and an intermediate portion extending between said upper and lower ends and connected pivotally to said front end portion of said seat member;

a parallel pair of rear leg members disposed respectively at said lateral sides of said seat member and disposed rearwardly of said front leg members, respectively, each of said rear leg members having an upper end mounted pivotally on said second portion of a respective one of said armrest members, a lower end adapted to be disposed on the ground surface, and an intermediate portion extending between said upper and lower ends of said rear leg member; and a pair of pivot members disposed respectively at said lateral sides of said backrest member, each of said pivot members having a first end mounted pivotally on said lower end of said backrest member and a second end mounted pivotally on said intermediate portion of a respective one of said rear leg members;

said chair assembly being movable between an unfolded state, in which said backrest member and said front and rear leg members are substantially upright, and said seat member and said armrest members are substantially horizontal, and a folded state, in which said backrest member, said seat member, said armrest members and said front and rear leg members are substantially upright and in which said front leg members are disposed between said rear leg members and are generally parallel to said rear leg members.

2. The foldable chair assembly according to claim 1, wherein each of said armrest members has a downwardly extending first side wall proximate to the respective one of said lateral sides of said seat member, and a downwardly extending second side wall opposite to and spaced apart from said first side wall in the transverse direction, each of said front leg members being disposed between said first and second side walls of the respective one of said armrest members and being disposed proximate to said first sidewall, each of said rear leg members being disposed between said first and second side walls of the respective one of said armrest members and being disposed proximate to said second side wall.

3. The foldable chair assembly according to claim 2, wherein each of said armrest members has a bottom side formed with a downwardly extending partition wall between said first and second side walls, said partition wall extending in the longitudinal direction of said armrest member for dividing said armrest member into said first and second portions, each of said front leg members being disposed between said first side wall and said partition wall of the respective one of said armrest members when said chair assembly is in the folded state, each of said rear leg members being disposed between said second side wall and said partition wall of the respective one of said armrest members when said chair assembly is in the folded state.

4. The foldable chair assembly according to claim 2, wherein each of said armrest members has a bottom side provided with a pivot pin which extends in the transverse direction between said first and second side walls, said upper end of each of said front leg members being mounted pivotally on said pivot pin of the respective one of said armrest members, said pivot pin being provided with a stop member that is disposed between said second side wall and said upper end of the respective one of said front leg members to retain said upper end of the respective one of said front leg members in said first portion of said armrest member and to prevent said upper end of the respective one of said front leg members from moving along said pivot pin toward said second side wall.

5. The foldable chair assembly according to claim 2, wherein each of said armrest members has a bottom side provided with a cylindrical pivot shaft which extends in the transverse direction between said first and second side walls, said pivot shaft having a first section proximate to said first side wall and disposed in said first portion of said armrest member, and a second section proximate to said second side wall and disposed in said second portion of said armrest member, said upper end of each of said front leg members being mounted pivotally on said first section of said pivot shaft of the respective one of said armrest members, said upper end of each of said rear leg members being mounted pivotally on said second section of said pivot shaft of the respective one of said armrest members.

6. The foldable chair assembly according to claim 5, wherein said upper end of each of said front leg members is provided with a first tubular sleeve which is sleeved rotatably on said first section of said pivot shaft of the respective one of said armrest members, and said upper end of each of said rear leg members is provided with a second tubular sleeve which is sleeved rotatably on said second section of said pivot shaft of the respective one of said armrest members.

7. The foldable chair assembly according to claim 5, wherein each of said first and second side walls of each of said armrest members has an inner surface confronting the other one of said first and second side walls, said inner surface being formed with a retaining groove which includes a slide groove portion extending in the longitudinal direction of said armrest member and a series of engaging groove portions communicated with and extending upwardly from said slide groove portion, said pivot shaft of each of said armrest members having two opposite ends which extend respectively into said retaining grooves in said inner surfaces and which are slidable along said slide groove portions and extendible into a confronting pair of said engaging groove portions for engaging the confronting pair of said engaging groove portions.

* * * * *